US007032549B1

(12) United States Patent
Verner et al.

(10) Patent No.: US 7,032,549 B1
(45) Date of Patent: Apr. 25, 2006

(54) VALVE LIFT SENSOR

(75) Inventors: Douglas R. Verner, Sterling Heights, MI (US); Craig D. Marriott, Clawson, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/968,592

(22) Filed: Oct. 19, 2004

(51) Int. Cl.
*F01L 9/04* (2006.01)

(52) U.S. Cl. ..... 123/90.11; 123/90.15; 123/188.5; 123/188.9; 251/129.05; 251/129.06; 251/129.15; 251/129.21; 116/277

(58) Field of Classification Search ..... 123/90.11
See application file for complete search history.

(56) References Cited

U.S. PATENT DOCUMENTS 4,914,566 A * 4/1990 Steutermann ..... 700/56
5,983,847 A * 11/1999 Miyoshi et al. ..... 123/90.11
6,293,303 B1 * 9/2001 Mori et al. ..... 137/554
6,382,246 B1 * 5/2002 Mori et al. ..... 137/554

FOREIGN PATENT DOCUMENTS

DE 3437150 A * 4/1986

* cited by examiner

*Primary Examiner*—Thomas Denion
*Assistant Examiner*—Kyle M. Riddle
(74) *Attorney, Agent, or Firm*—Christopher DeVries

(57) ABSTRACT

A valve lift sensor detects the position of an engine valve. The valve lift sensor includes a movable target carried on an engine valve and a stationary coil carried within an engine valve assembly. A signal generator energizes the coil with an oscillating voltage to create an oscillating magnetic field, which is concentric to the coil for inductive transfer with the target. A comparator compares the voltage from the signal generator with the voltage at the resistor to determine the phase lag of resistor voltage relative to signal generator voltage and indicate the engine valve position. Using the phase lag, the comparator provides a pulse-width-modulated signal with a duty cycle proportional to the valve lift to an engine valve control operable to control the operation of the engine valve.

16 Claims, 2 Drawing Sheets

VALVE LIFT SENSOR

TECHNICAL FIELD

This invention relates to engine valve lift position sensors and, more particularly, to an engine valve lift sensor capable of providing a linear output signal which varies with the position of an engine valve during an engine valve cycle.

BACKGROUND OF THE INVENTION

Hall effect sensors are known in the art for tracking engine valve operation. However, Hall effect sensors provide a non linear output signal which is not capable of accurately detecting the position of the engine valve during an engine valve cycle.

A low cost valve sensor capable of providing a linear output signal for accurately determining the position of an engine valve during an engine valve cycle is desired.

SUMMARY OF THE INVENTION

The present invention provides a low cost engine valve sensor capable of providing a linear output signal which varies with the position of an engine valve during an engine valve cycle.

The engine valve sensor is carried by an engine valve assembly. In an exemplary embodiment, the engine valve assembly includes an engine valve housing such as a cylinder head carrying an engine valve having a valve stem and a valve head at one end of the valve stem. The stem extends into the valve housing and is sealed by a valve stem seal. A valve spring retainer is carried by the stem, and axially spaced from the valve stem seal. A spring extends between the valve stem seal and the valve spring retainer to bias the engine valve toward a closed position.

The sensor assembly includes a signal generator, such as an oscillator, which excites a stationary coil, carried directly or indirectly by the engine valve housing and a current measuring device such as a resistor in series with the coil. Spaced adjacent the coil is a movable electrically conductive target, for example metallic, carried directly or indirectly by the valve. The coil, when energized by the signal generator creates an oscillating magnetic field which induces eddy currents in the target to the degree in which the magnetic field engages the target. The eddy currents in the target result in an energy loss which causes a phase lag in the coil current and the voltage across the resistor relative to the signal generator voltage that varies with the valve lift position. A comparator, such as an Exclusive OR gate integrated circuit, can thus determine the position of the target and the engine valve based upon the degree of phase lag from the generated driving signal.

The position of the target and the coil within the valve spring and the use of an Exclusive OR gate comparator circuit define a system that can be applied to a multicylinder engine at a comparatively low cost.

These and other features and advantages of the invention will be more fully understood from the following description of certain specific embodiments of the invention taken together with the accompanying drawings.

DESCRIPTION OF THE PREFERRED EMBODIMENT

Figure 1:
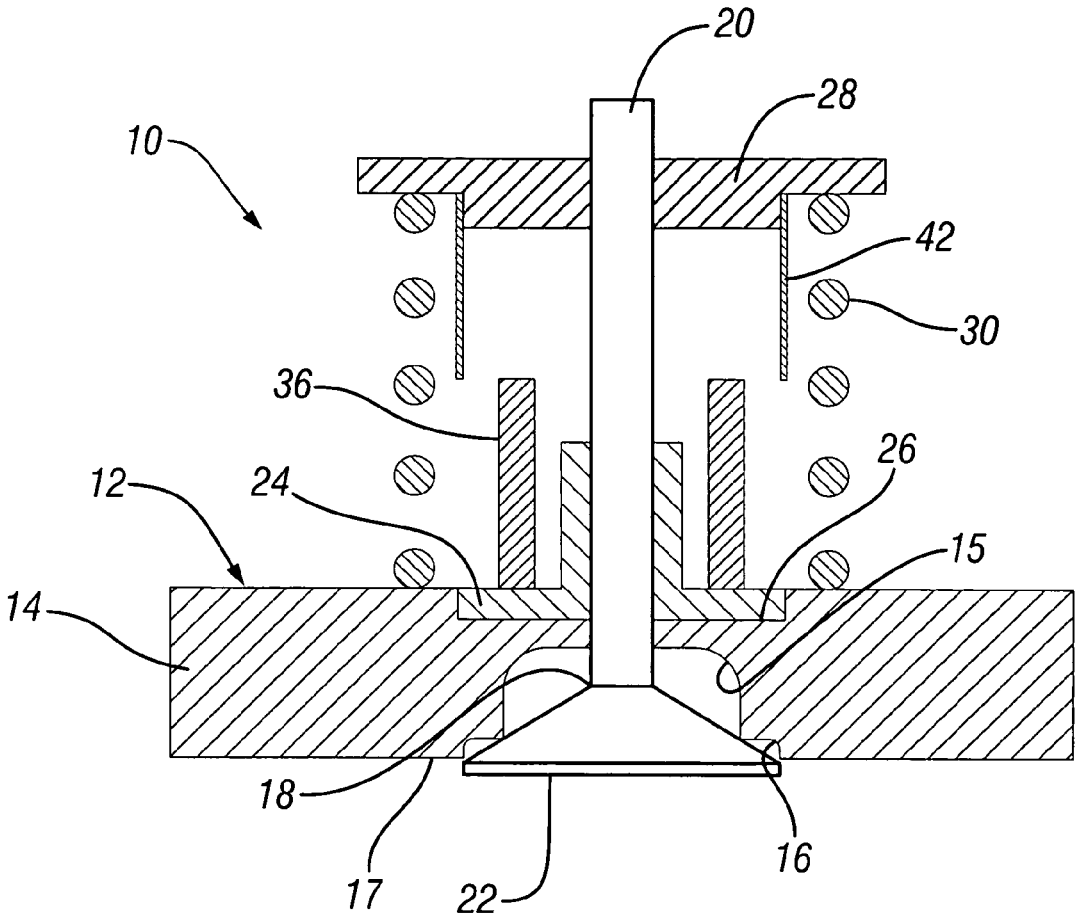
FIG. 1 is a diagrammatic view of an exemplary embodiment of an engine valve assembly utilizing a valve lift position sensor according to the present invention.

Referring first to FIG. 1 of the drawings in detail, numeral 10 generally indicates an exemplary engine valve assembly. The assembly 10 is integrated into a cylinder head 12 defining a valve housing 14 with at least one valve port 15 having an opening 16 in communication with a combustion chamber 17 of an engine. The cylinder head 12 also includes a movable engine valve 18 for each opening 16. Each engine valve 18 has a valve stem 20 with a valve head 22 at one end of the valve stem and engagable with the opening 16. The engine valve 18 is movable between open and closed positions relative to its respective opening 16. It should be understood that the engine valve 18 may be either an intake or an exhaust valve and may be electrohydraulically or electromechanically driven.

A valve stem seal 24, fitted into a recess 26 of the valve housing 14 engages the circumferential surface of the valve stem 20 to seal against oil leakage into the valve port 15. A valve spring retainer 28 is carried on the valve stem 20 and is axially spaced a distance from the valve stem seal 24. An engine valve spring 30 is disposed about the valve stem 20 between the valve housing 14 and the valve spring retainer 28 to bias the engine valve 18 toward the closed position so that the valve head 22 closes the opening 16, as shown in FIG. 1.

Figure 2:
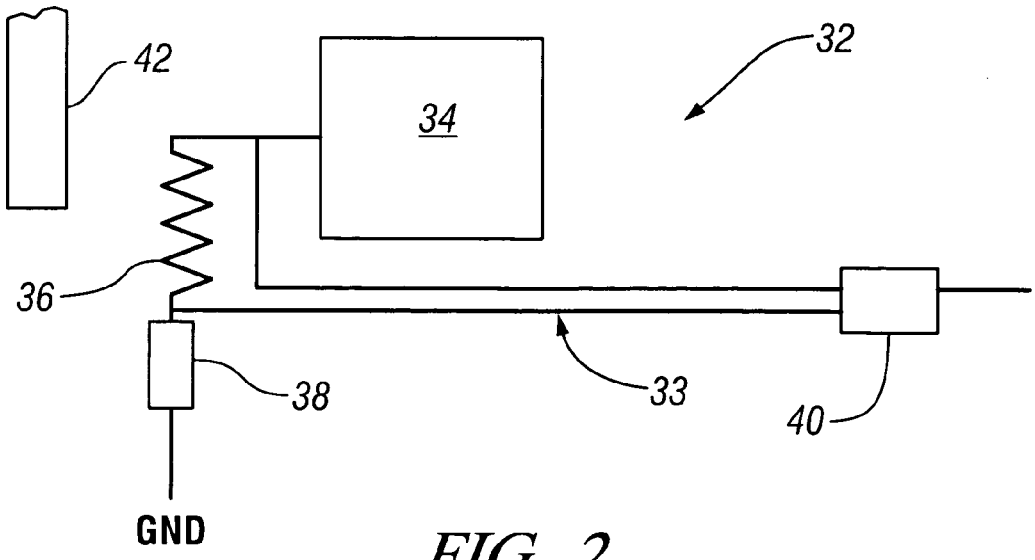
FIG. 2 is a circuit diagram of the valve lift position sensor of the present invention.

A sensor assembly 32, as illustrated in FIG. 2, operates to determine the position of the engine valve during engine valve actuation. The sensor assembly 32 includes a circuit 33 having a signal generator 34, such as an oscillator, which passes electrical current through a stationary coil 36 and a resistor 38 in series, so that all of the current that passes through the coil passes through the resistor and can be measured by the voltage drop across the resistor. The circuit also includes a comparator 40, such as an Exclusive OR gate, that compares the voltage drop across the resistor 38 with the voltage supplied from the signal generator 34.

Referring now to FIG. 1, showing one possible integration of the sensor assembly 32 with the valve assembly 10, the coil 36 is disposed between the valve stem 20 and the engine valve spring 30 and is carried on the valve stem seal 24. A movable conductive target 42 is carried on the valve spring retainer adjacent the coil 36. However, the target 42 may be alternatively carried on or integrated into the valve stem 20 of the engine valve 18 adjacent the coil 36.

In operation, the engine valve 18 is moved between the closed position and the opened position to allow fluids to be transferred in and out of an associated combustion chamber for engine operation.

The position of the engine valve 18 is monitored by the sensor assembly 32. The signal generator 34 energizes the coil 36 with an oscillating voltage to create an oscillating magnetic field, which is concentric to the coil. The oscillating magnetic field induces eddy currents in the target which in turn create reactive magnetic fields. These increase in strength as the valve is opened and the target engages more of the coil magnetic field so that the eddy currents increase and a greater phase shift results between voltage of the signal generator and the current in the coil and the resistor.

The reactive fields of the eddy currents affect current flow through the coil by creating a lag in the current phase of the coil 36 and the resistor 38 relative to the phase of voltage supplied by the signal generator 34. The phase of current in the resistor 38 is then compared to the phase of voltage from the signal generator 34 in the comparator 40. The comparator 40 then provides a pulse-width-modulated signal with a duty cycle proportional to the valve lift. This signal can be read directly by an engine valve controller, not shown, using a digital timing circuit. Alternatively, the output of the comparator 40 can be converted to an analog signal using a filter, not shown.

In the subject invention, the supply power is lost to heat by both the resistor and eddy currents dependent on the amount of engagement of the target with the magnetic field of the coil. This engagement is directly proportional to the engine valve lift when the target is affixed to the valve and the coil is affixed to the cylinder head as shown in FIG. 1. Therefore, the phase lag shift of the current through the coil and resistor relative to the signal generator voltage may be linearly related to valve lift.

As the target 42 moves closer to the coil 36, in an engine valve 18 open position, the amount of phase lag in the coil and the resistor increases. As the target 42 moves away from the coil 36, in an engine valve 18 closing position, the amount of phase lag in the coil and the resistor decreases. Accordingly, the position of the target 42 (and the valve) relative to the coil 36 can be measured by comparing the amount of phase shift/lag between the current or the voltage drop across the resistor 38 and the supply voltage from the signal generator 34.

Figure 3:
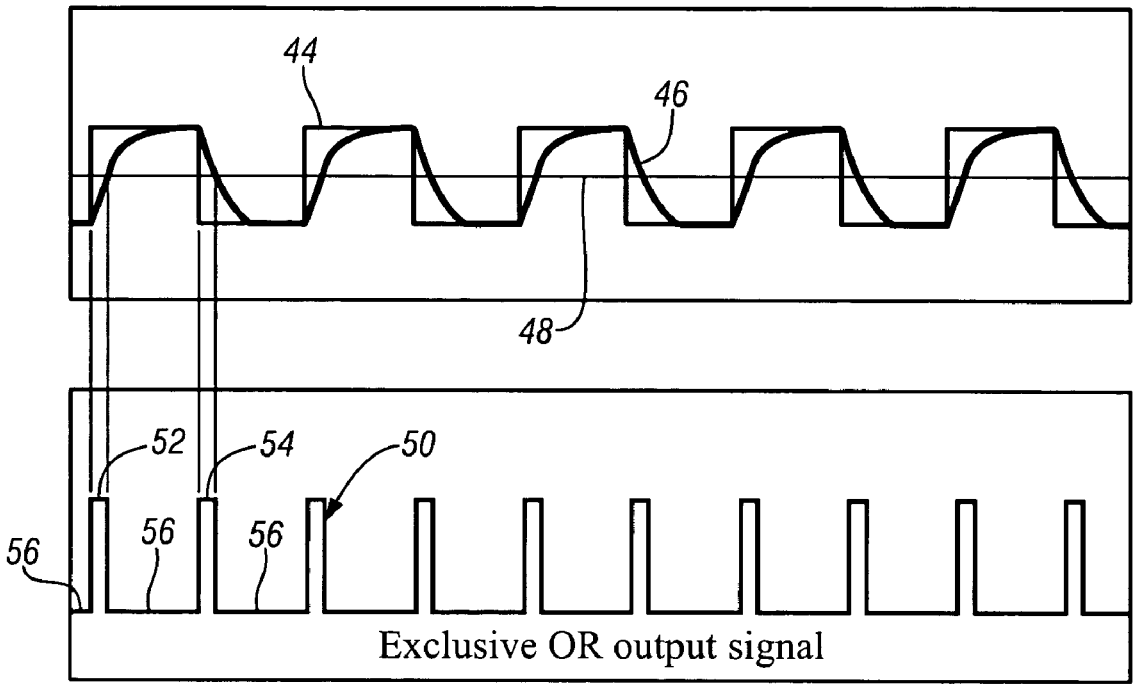
FIG. 3 is a graph illustrating signal processing of an Exclusive OR discrete logic gate used in conjunction with the present invention.

FIG. 3 is a graph illustrating signal processing of the Exclusive OR gate. The upper portion of the graph illustrates an overlay of signal generator voltage and the voltage measured between the resistor 38 and the coil 36. Signal generator voltage is represented by a square wave line 44 while the voltage measured between the resistor and the coil is represented by a variable wave line 46. A threshold line 48, approximately bisecting the amplitude of the square wave line 44 to define a "High" state above the line 48 and a "Low" state below the line 48.

The lower portion of the graph illustrates the Exclusive OR output signal relative to the upper portion of the graph. Line 50 represents a variable duty cycle digital signal with a frequency twice that of the signal generator frequency. Specifically, for each signal generator cycle two output signals are generated, shown as peaks 52 and 54. The width of each output signal is proportional to the response delay (phase lag) of the resistor voltage relative to the signal generator voltage.

The Exclusive OR output signal is determined according to the following logic. When the state of the signal generator voltage and the resistor voltage are the same, the output signal is "Low", as illustrated by portions 56 of line 50. However, when the state of the signal generator voltage and the resistor voltage are different, a "High" output signal is generated, as illustrated by portions 52 and 54 of line 50, until the states become the same. Thus, the duty cycle (or width) of the output signals 52, 54 is proportional to the response delay (phase lag) of the resistor voltage, which is proportional to valve lift.

If desired, the sensor assembly 32 may be modified so that the signal generator 34 supplies voltage, in parallel, to multiple sensor assemblies, similar to sensor assembly 32, positioned throughout an engine valve train to track the positions of multiple engine valves.

In the illustrated embodiment, the valve spring extends between a valve seat on the cylinder head and a valve retainer attached to the valve stem and biases the valve toward a closed position. However, the present invention can also be applied to other forms of valve springs which bias a valve to a mid position or an open position as well to valves actuated without valve springs.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

The invention claimed is:

1. An engine valve assembly, including an engine valve housing defining at least one opening, an engine valve movable between open and closed positions within the opening, a valve stem seal carried by the valve housing and sealingly engaging the engine valve, and a valve lift sensor comprising:

a stationary electrical coil carried by the engine valve housing;

a movable conductive target carried by the engine valve and movable with the valve into greater and lesser proximity to the coil as the valve is opened and closed, respectively;

a signal generator operative to apply an alternating voltage signal to the coil and a resistor in series and thereby create an oscillating magnetic field about the coil for inductive transfer of energy to the movable target, causing a variable voltage through the coil to the resistor; and a comparator operative to compare the voltage from the signal generator with the voltage at the resistor to determine the phase lag of resistor voltage relative to signal generator voltage and indicate the engine valve position;

wherein the stationary coil is carried by the valve stem seal.

2. A method of determining engine valve lift position, comprising the steps of:

providing an engine valve assembly including an engine valve housing defining at least one opening, an engine valve movable between open and closed positions within the opening and biased toward the closed position by a valve spring surrounding a stem of the valve, a stationary electrical coil carried by the engine valve housing and surrounding the valve stem, a movable conductive target carried by the engine valve and positioned radially between the stationary coil and the valve spring, the target being movable with the valve into greater and lesser proximity to the coil as the valve is opened and closed, a signal generator operative to apply an alternating voltage signal to the coil and a resistor in series causing a variable current flow through the coil and the resistor and thereby creating an oscillating magnetic field about the coil for inductive transfer of energy to the movable target, and a comparator operative to compare the voltage from the signal generator with the voltage between the coil and the resistor to determine the phase lag of resistor voltage relative to signal generator voltage and thereby indicate the engine valve position; wherein moving the engine valve during engine operation causes equivalent motion (movement) of the target carried on the valve relative to the stationary coil thus causing a variation in the phase lag which indicates the continuous variations in valve lift position.

3. A method as in claim 2 including creating an output signal proportional to valve lift from the phase lag between the voltage at the resistor and the coil to the output voltage from the signal generator.

4. A method as in claim 3 wherein the signal is pulse width modulated with a duty signal proportional to pulse width.

5. A method as in claim 3 including relaying the signal to an engine valve control.

6. An engine valve assembly including an engine valve housing defining at least one opening, an engine valve including a head movable between open and closed positions within the opening and a valve stem extending from the head and slidably carried in the housing, a spring retainer carried on the valve stem, a valve spring surrounding the valve stem and operatively extending between the retainer and the housing, the spring biasing the valve toward the closed position, and a valve lift sensor comprising:

a stationary electrical coil carried by the housing and surrounding the valve stem;

a movable conductive target carried by the engine valve and movable with the valve into greater and lesser proximity to the coil as the valve is opened and closed;

a signal generator operative to apply an alternating voltage signal to the coil and a resistor in series and thereby create an oscillating magnetic field about the coil for inductive transfer of energy to the movable target, causing a variable voltage through the coil to the resistor; and a comparator operative to compare the voltage from the signal generator with the voltage at the resistor to determine the phase lag of resistor voltage relative to signal generator voltage and indicate the engine valve position.

7. An assembly as in claim 6 including a secondary member carried by the housing wherein the stationary coil is carried by the secondary member.

8. An assembly as in claim 7 wherein the secondary member is a valve stem seal.

9. An assembly as in claim 6 wherein the target is positioned radially outward of the stationary coil.

10. An assembly as in claim 9 wherein the target is positioned inward of the spring.

11. An assembly as in claim 7 wherein the target is positioned generally intermediate the stationary coil and the secondary member.

12. An assembly as in claim 11 wherein the secondary member is a valve stem seal.

13. An assembly as in claim 7 wherein the target is carried by the spring retainer.

14. An assembly as in claim 6 wherein the comparator is an Exclusive OR gate.

15. An assembly as in claim 6 wherein the signal generator is an oscillator.

16. An assembly as in claim 6 wherein the comparator provides a pulse width modulated signal with a duty cycle proportional to engine valve lift.

* * * * *